US005123444A

United States Patent [19]

Persson et al.

[11] Patent Number: 5,123,444

[45] Date of Patent: Jun. 23, 1992

[54] BACK FLOW BLOCKER IN SLOPING PIPES

[76] Inventors: Mats Persson, Kremlevägen 7, Karlshamn, Sweden, S-292 00; Kjell Warnquist, Doppingstigen 4, Nättraby, Sweden, S-370 24

[21] Appl. No.: 680,640

[22] Filed: Apr. 2, 1991

Related U.S. Application Data

[63] Continuation of Ser. No. 424,274, filed as PCT/SE88/00211, Apr. 26, 1988, abandoned.

[30] Foreign Application Priority Data

Apr. 27, 1987 [SE] Sweden ..... 8701711-7

[51] Int. Cl.[5] ..... E03F 7/04

[52] U.S. Cl. ..... 137/578; 137/579

[58] Field of Search ..... 137/396, 398, 438, 578, 137/579, 590, 592, 613; 405/39, 90, 92, 96

[56] References Cited

U.S. PATENT DOCUMENTS

| | | | |
|---|---|---|---|
| 306,523 | 10/1884 | Read | 137/578 |
| 1,108,090 | 8/1914 | Barieau | 137/578 |
| 2,079,063 | 5/1937 | Brosius | 137/578 X |
| 2,536,052 | 1/1951 | Gohlke | 137/578 X |
| 4,321,948 | 3/1982 | Bradley | 137/579 |

FOREIGN PATENT DOCUMENTS

| | | | |
|---|---|---|---|
| 1609090 | 4/1970 | Fed. Rep. of Germany . | |
| 3202354 | 7/1983 | Fed. Rep. of Germany . | |
| 155299 | 1/1960 | Norway . | |
| 731965 | 6/1955 | United Kingdom | 137/578 |

*Primary Examiner*—John Rivell

*Attorney, Agent, or Firm*—Merchant & Gould Smith, Edell, Welter & Schmidt

[57] ABSTRACT

Back flow blocker in sloping pipes, comprising a well vat (10) provided with an inlet (14) and an outlet (15) to be connected to the pipe. A tube (16) provided within the well vat and being connected at a first end to the inlet and opening at a second end in the well vat is arranged as a floating tube and is pivotally mounted in said first end to be pivoted in vertical direction from an essentially horizontal normal position when water is accumulated in the well vat maintaining said second end above the level of the water in the well vat.

21 Claims, 4 Drawing Sheets

BACK FLOW BLOCKER IN SLOPING PIPES

Figure 2:
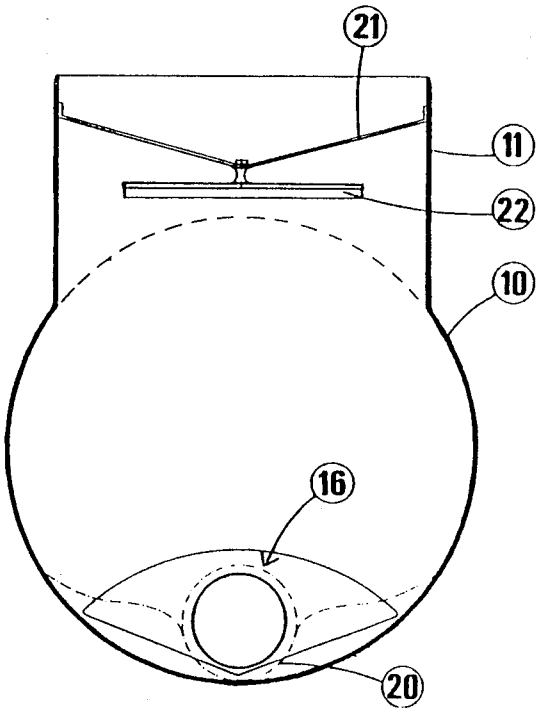

This is a continuation of application Ser. No. 07/424,274, filed as PCT/SE88/00211, Apr. 26, 1988, now abandoned.

The invention relates to a back flow blocker in sloping pipes, such as waste water and surface water pipes, i.e. a device preventing back flow of water in for instance a waste pipe, comprising a well vat having an inlet and an outlet which are connected to the pipe.

Back flow water problems in municiple pipes and damages in connection therewith have increased heavily during the last years. Several reasons of the problems exist, for instance that the load on the municiple pipe net works has increased due to a concentration of the settlement, that increasing areas are hardened, and that large portions of the pipe net works leak due to age or carelessness during construction. This means that undesired water is fed to or leaks into waste water or surface water pipes in connection with heavy rains or rapid melting of snow resulting in an overload of the pipes.

Another reason of the overload of the pipes is backflow of water into the pipes through overflows or untight pipes in connection with seasons of high water in lakes or rivers.

When a pipe is overloaded waste water can rise in the sewerage of buildings connected to the pipe and flooding of the basements will take place. Water can also penetrate into the draining system of the foundation of the buildings and cause an overflow of the foundation followed by moisture and mould damages in the buildings.

At present several types of back flow blockers exist which close automatically if water flows in a direction reverse to the normal direction. As an example the high water door is mentioned which is mounted at overflows to prevent a backflow of water in the pipe during high water. Quite easily litter or sludge keeps the door open allowing a back flow of water through the door. To ensure a well functioning high water door a regular lubrication and maintenace is required. A similar type is the non-return valve having a flap, which is easily plugged by sludge and paper when there is a low flow of water. Also existing are back flow blockers which utilize floating bodies. These are used in connection with floor outlets in buildings and in connection with basins for draining, included in draining systems which are located in the soil, but all of these previously known back flow blockers have in common that they are constructed to function with waste water free from sludge and larger contaminents which means that the function will be impaired and the reliability will be substantially jeopardized, if the water is contaminated with litter and sludge.

An object of the invention is to eliminate the drawbacks of the present backflow blockers mentioned above and thus to provide a backflow blocker functioning satisfactorily without extensive maintenance and attandance also when litter and sludge occur in the water passing through the backflow blocker.

The above object is achieved by providing a backflow blocker of the type referred to above having the characteristics of claim 1.

Figure 1:
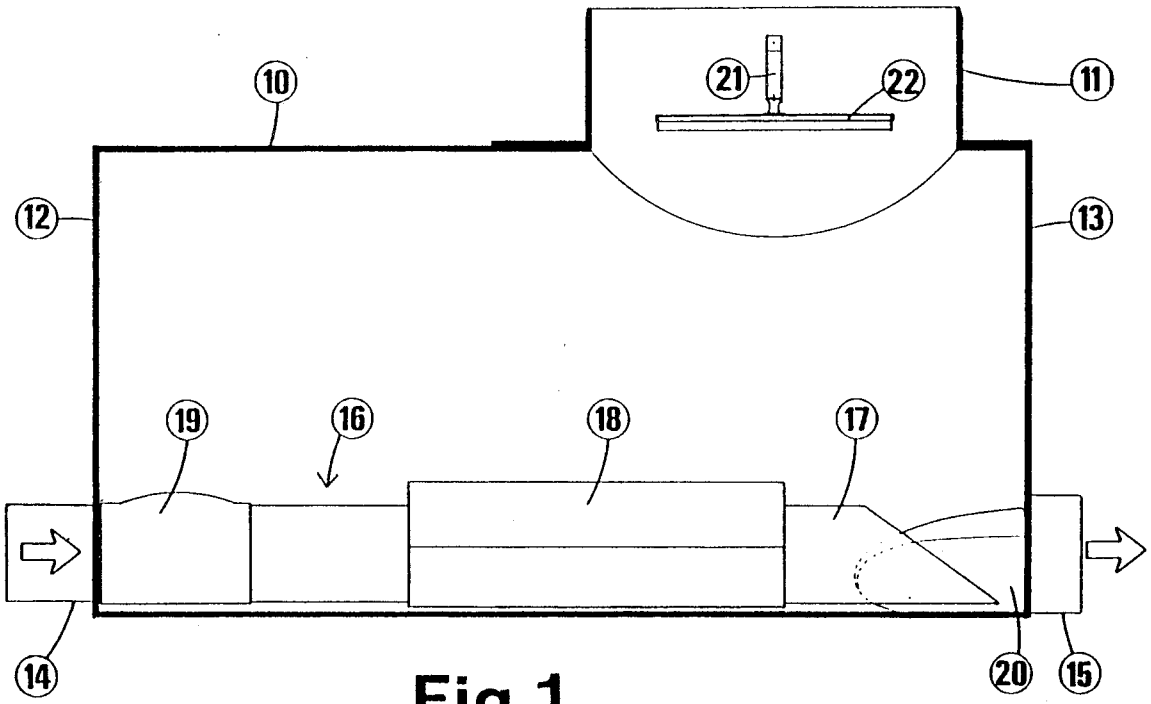
Figure 4:
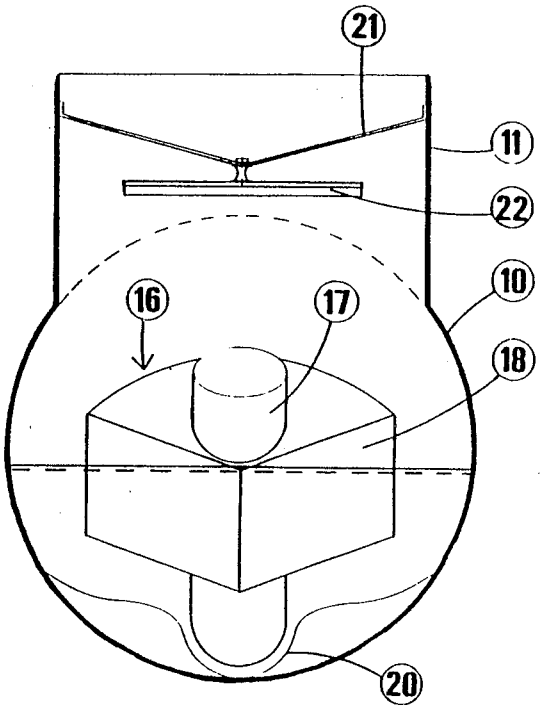
Figure 3:
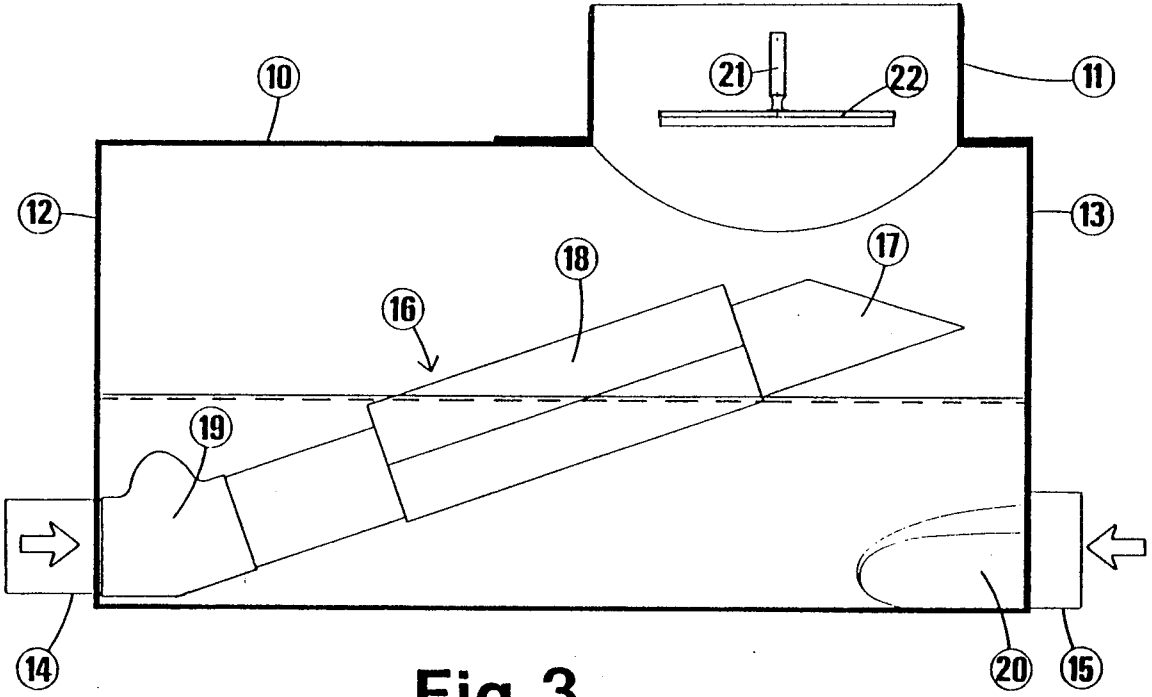
Figure 6:
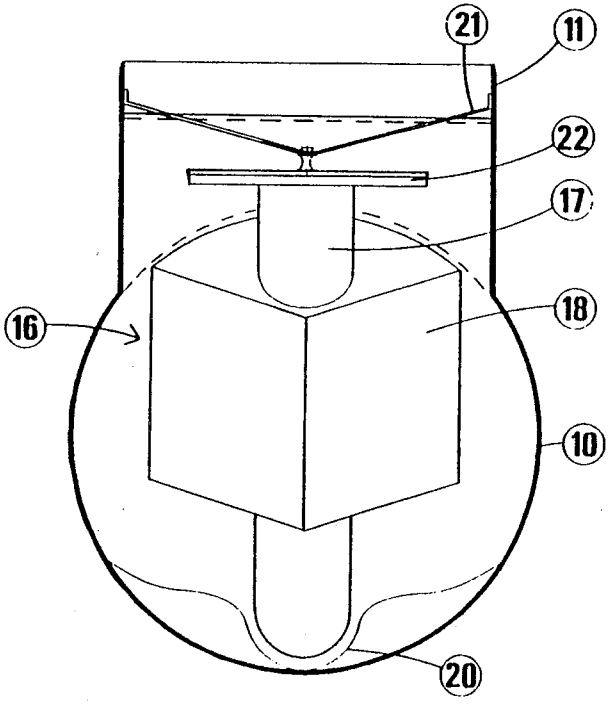
Figure 5:
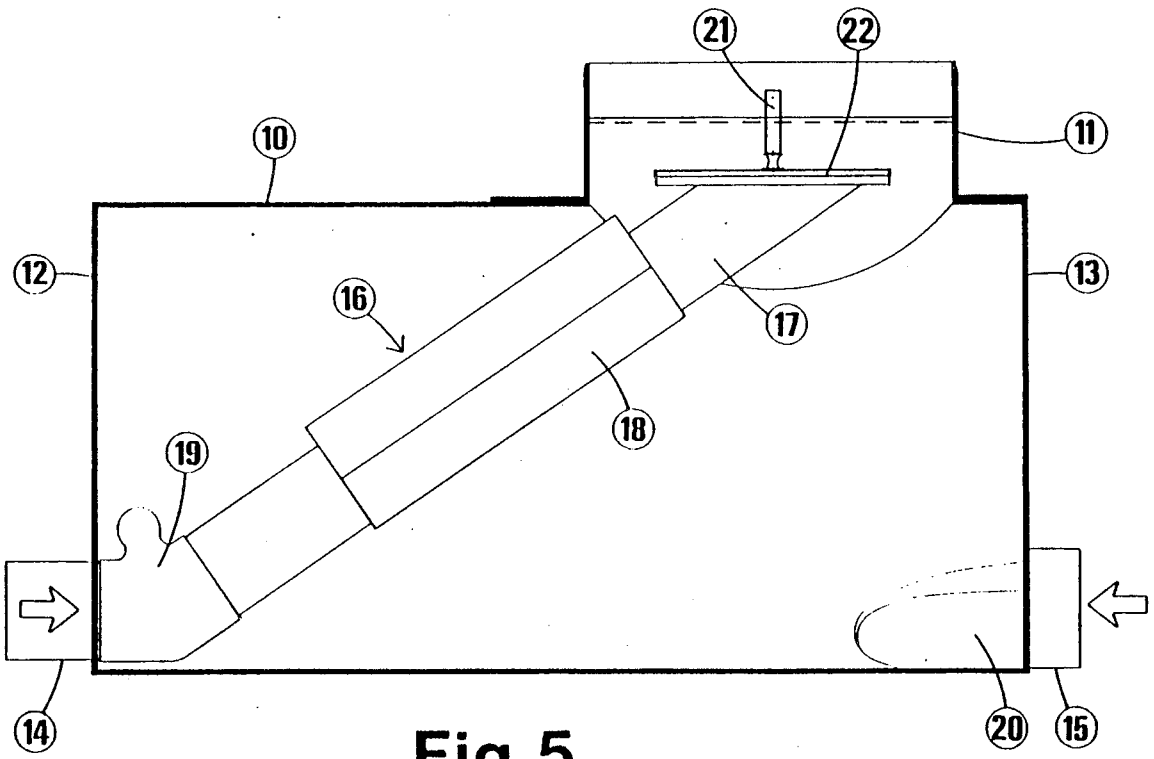
Figure 7:
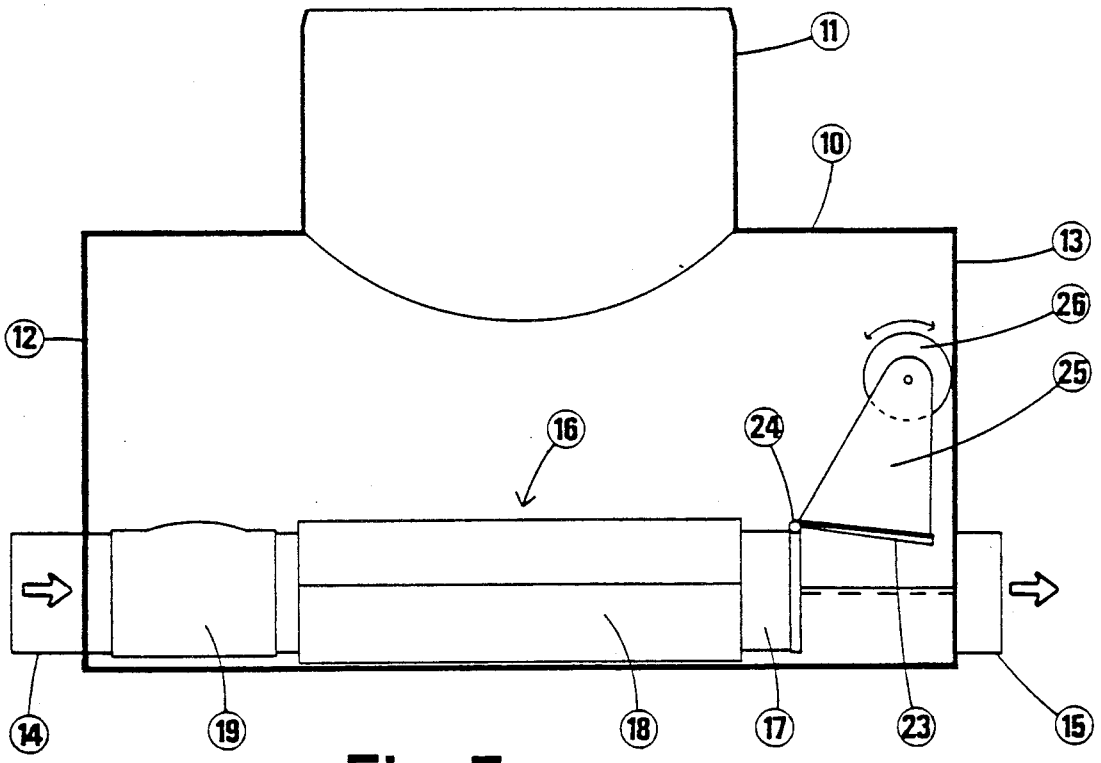
Figure 8:
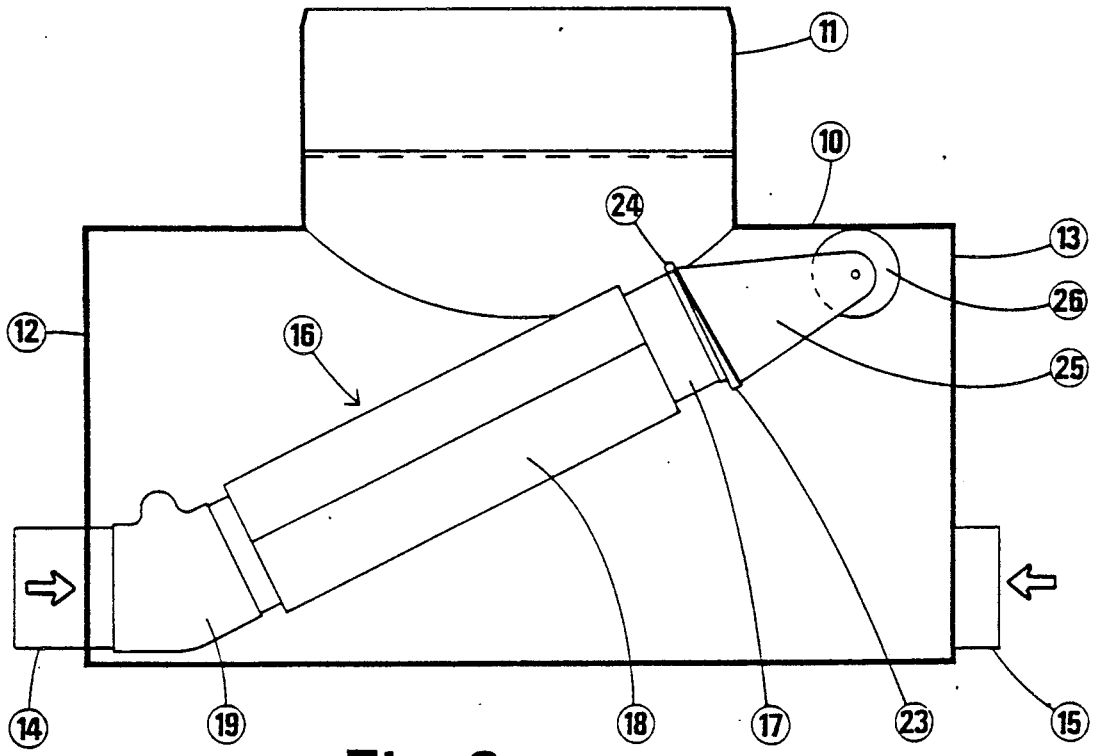

The invention will be described in more detail, reference being made to the accompanying drawings, in which:

FIGS. 1 and 2 are an axial sectional view and a cross-sectional view, respectively, of an embodiment of the backflow blocker according to the invention in the normal operating state, FIGS. 3 and 4 are corresponding views of the backflow blocker when the well vat is partly filled with water, FIGS. 5 and 6 are corresponding views of the backflow blocker when the well vat is filled with water to such an extent that the floating tube is pivoted to the upper end position, FIG. 7 is an axial sectional view of another embodiment of the backflow blocker according to the invention in the normal position, and FIG. 8 is an axial sectional view corresponding to the view of FIG. 7, the floating tube being pivoted to the upper end position thereof.

The backflow blocker according to FIGS. 1–6 comprises a well vat formed as a cylindrical reservoir 10 provided with a riser 11 arranged as an inspection piece. In opposite end walls 12 and 13 of the reservoir there is arranged a cylindrical inlet socket 14 and a cylindrical outlet socket 15, respectivley, adjacent to the bottom of the reservoir, and the sockets are arranged in axial alignment. The reservoir will be connected to a waste water or surface water pipe through the sockets resulting in a normal flow of water in the direction of the arrows according to FIG. 1. A floating tube 16, comprising a tube 17, which is not required to have floating properties and a floating body 18 made for instance of cellular plastics arranged to enclose the tube 17, the floating tube 16 in one end being connected to the inlet socket 14 through a flexible piece of hose 19, for instance made of rubber, making said end of the floating tube anchored for practically universal pivotal motion while the other end of the floating tube opens into the reservoir. The opening end of the tube 17 is cut off to be inclined at an acute angle to the bottom of the tube. Usually, the floating tube 16 extends along the bottom of the reservoir according to FIGS. 1 and 2, and the opening end thereof is in such case received in a groove 20 connected to the outlet socket 15 to bring the opening end into axial alignment with the socket 15.

In the upper part of the reservoir a plate 22 coated on the underside with an elastic sealing material, for instance rubber, is suspended within the riser 11 by means of a cross bar 21, the plate 22 being suspended in a centre position of the cross bar and being allowed a limited pivoting movement from the horizontal position.

When the floating tube 16 is positioned in the normal position according to FIGS. 1 and 2 water flows through the back flow blocker in the direction of the arrows from the inlet socket 14 on the up-stream side to the outlet socket 15 on the down-stream side through the floating tube 16, the flow capacity (inner diametre) of the outlet socket being at least equal to the flow capacity (inner diametre) of the inlet socket thereby preventing water from being accumulated in the reservoir during normal flow conditions.

In normal position the reservoir function as a normal manhole and inspection well.

If, for some reason, there is a back flow of water driving the water to flow backwards through the outlet socket 15 into the reservoir 10 according to FIG. 3, water will accumulate in the reservoir and force the floating tube 16 to float while pivoting in the link formed by the hose 19 to take for instance the position shown in FIGS. 3 and 4 while maintaining all the time the opening end of the floating tube above the water level in the reservoir and preventing water from flowing backwards through the floating tube 16 to the inlet socket 14.

If the water continues to rise in the reservoir the floating tube 16 will eventually reach the position shown in FIGS. 5 and 6 where the opening end of the floating tube is pressed against the underside of the plate 22 thereby closing the opening end. To guide the floating tube towards the plate 22 while the tube is pivoted in the upward direction—the universal joint formed by the tube 19 allows that the floating tube is given a pivoting movement also in the transversal direction—the top side of the floating body 18 is cylindrically curved about the edge between the reservoir and the riser to be centred by the engagement of the curved surface to said edge. By allowing the plate 22 to tilt to a certain extent the plate will cover as a sealing the opening of the floating tube even if the opening would not hit the plate absolutely at the centre. The water can now rise in the riser 11 above the opening end of the floating tube 16, there being no risk of the water flowing backwards into the inlet socket 14 through the floating tube.

When the level of the water in the reservoir goes down the floating tube will return to the normal position thereof according to FIGS. 1 and 2.

The reservoir 10 may, of course, have another cross section than a circular and the inlet socket and the outlet socket are not required to be arranged opposite each other. Neither are they required to be arranged adjacent to the bottom. If they are arranged at a distance above the bottom supporting means may be arranged for the floating tube keeping it essentially horizontal in the normal position. The tube 17 may have a floating capacity of its own, a specific floating body thereby possibly being avoided, and the joint formed by the hose 19 can be replaced by another type of a turning joint for instance a ball joint. However, the disclosed embodiment is advantageous because there are no moving parts rusting or being obstructed. Moreover, the plate 22 is well protected from litter and sludge when positioned in the riser 11, from that position also being easily inspected and cleaned.

In the embodiment of FIGS. 7 and 8 the floating tube 16 is provided with a cover 23 pivotally mounted on the tube 17 at the upper edge of the opening end at 24. The cover could be provided with sealing means so as to engage the opening edge of the tube in a sealing manner. A fork 25 having a swivel roller 26 is provided on the cap. In the normal position according to FIG. 7 the roller engages the downstream end wall 13 of the reservoir keeping the cap in an open position and allowing water to flow unrestrictedly from the inlet socket 14 through the floating tube 16 to the outlet socket 15 as indicated by the arrows of FIG. 7.

When water is accumulated in the reservoir at a backflow from the outlet socket 15 the floating tube is pivoted upwards with the opening above the level of the water in the reservoir as previously described in connection with the embodiment according to FIGS. 1-6 to prevent an inflow of water in the inlet socket 14 through the floating tube, and when occuring the roller 26 eventually engages the ceiling of the reservoir thereby turning the cap 23 to the closed position according to FIG. 8 allowing water to rise above the floating tube 16 into the riser 11, still preventing a flow of water through the floating tube to the inlet socket.

The cap 23 can be controlled in other ways than shown in FIGS. 7 and 8, for instance by means of a rope anchoring device or by means of fixed guideways in the reservoir, the cap preferably being biased to opened or closed position by means of a spring.

The embodiment according the FIGS. 7 and 8 requires less space than the embodiment of FIGS. 1-6 and is intended especially for rather thin lines.

We claim:

1. Back flow blocker in sloping pipes, comprising a well vat having an inlet and an outlet which are connected to the pipe; said inlet and said outlet being arranged adjacent to the bottom of said well vat; and a tube provided within said well vat and connected at a first end to said inlet, a second end thereof opening in a normal position, supported on said bottom, into said well vat adjacent to said outlet for passing liquid continuously into said outlet, said tube being arranged as a floating tube and being pivotally mounted at said first end to be pivoted in a vertical direction from said normal position when liquid is accumulated in said well vat while said second end is moved to and detained in a position above the surface of the accumulated liquid.

2. Back flow blocker according to claim 1, wherein said inlet and outlet are arranged in front of each other in opposite side walls or parts of side walls of said well vat, said floating tube in normal position being arranged essentially in alignment with said inlet and said outlet.

3. Back flow blocker according to claim 1, wherein said floating tube comprises a tube and a floating body provided externally on said tube.

4. Back flow blocker according to claim 1, wherein said second end of said floating tube, having a bottom, is obliquely cut off at an acute angle to said bottom of said tube, and wherein said floating tube in a pivoted upper end position is engaged with a closing means provided stationary in said well vat.

5. Back flow blocker according to claim 1, wherein said well vat is provided at a reservoir having a riser arranged as an inspection piece.

6. Back flow blocker according to claim 1, characterized in that the floating tube (16) in said second end is provided with a pivoted cap (23) guided from an open to a closed position when the floating tube is pivoted from the normal position to a pivoted upper end position.

7. Back flow blocker according to claim 6, characterized in that the cap (23) is guided on the inside of the well vat.

8. Back flow blocker in sloping pipes, comprising a well vat having an inlet and an outlet which are connected to the pipe; and a tube, having a bottom, provided within said well vat and connected at a first end to said inlet, the second end thereof opening in a normal position into said well vat adjacent to said outlet for passing liquid continuously into said outlet, said tube being arranged as a floating tube and being pivotally mounted at said first end to be pivoted in a vertical direction from said normal position when liquid is accumulated in said well vat while said second end is moved to and detained in a position above the surface of the accumulated liquid; said floating tube being obliquely cut off at an acute angle to said bottom of said tube, and said floating tube in a pivoted upper end position being engaged with a closing means provided stationary in said well vat; said closing means being arranged in a riser arranged as an inspection piece.

9. Back flow blocker according to claim 8, wherein said floating tube comprises a tube and a floating body provided externally on said tube.

10. Back flow blocker in sloping pipe, comprising a well vat having an interior surface, and having an inlet and an outlet which are connected to the pipes; and a tube provided within said well vat and connected at a first end to said inlet, a second end thereof opening in a normal position into said well vat adjacent to said outlet for passing liquid continuously into said outlet, said tube being arranged as a floating tube and being pivotally mounted at said first end to be pivoted in a vertical directed from said normal when liquid is accumulated in said well vat while said second end is moved to and detained in a position above the surface of the accumulated liquid; said floating tube including a tube and a floating body, having an upper side, provided externally on said tube; said upper side of said floating body being defined by a curved surface which can be engaged to a portion of said interior surface of said well vat to center said floating tube when said floating tube is pivoted upwardly.

11. Back flow blocker according to claim 10, wherein said second end of said floating tube, having a bottom, is obliquely cut off at an acute angel to said bottom of said tube, and wherein said floating tube in a pivoted upper end position is engaged with a closing means provided stationary in said well vat.

12. Back flow blocker according to claim 10, wherein said well vat is provided at a reservoir having a riser arranged as an inspection piece.

13. Back flow blocker in sloping pipes, comprising a well vat having an interior surface and having an inlet and an outlet which are connected to the pipe; and a tube, having a bottom, provided within said well vat and connected at a first end to said inlet, a second end thereof opening in a normal position into said well vat adjacent to said outlet for passing liquid continuously into said outlet, said tube being arranged as a floating tube, having an upper side, and being pivotally mounted at said first end to be pivoted in a vertical direction from said normal position when liquid is accumulated in said well vat while said second end is moved to and detained in a position above the surface of the accumulated fluid; said second end of said floating tube being obliquely cut off at an acute angle to said bottom of said tube and said floating tube in a pivoted upper end position being engaged with a closing means provided stationary in said well vat;

said upper side of said floating tube being defined by a curved surface which can be engaged to a portion of said interior surface of said well vat to center said floating tube when said floating tube is pivoted upwardly.

14. Back flow blocker according to claim 13, wherein said well vat is provided at a reservoir having a riser arranged as an inspection piece.

15. Back flow blocker in sloping pipes, comprising a well vat having an inlet and an outlet which are connected to the pipe; and a tube, having an exterior surface, provided within said well vat and connected at a first end to said inlet, a second end thereof opening in a normal position into said well vat adjacent to said outlet for passing liquid continuously into said outlet, said tube being arranged as a floating tube and being pivotally mounted at said first end to be pivoted to a vertical direction from said normal position when liquid is accumulated in said well vat while said second end is moved to and detained in a position above the surface of the accumulated liquid;

said well vat being provided at a reservoir having a riser arranged as an inspection piece;

an upper side and exterior surface of said floating tube being defined by a curved surface which can be engaged to an edge between said reservoir and said riser to center said floating tube when said floating tube is pivoted upwardly.

16. Back flow blocker in sloping pipes comprising a well vat having an inlet and an outlet which are connected to the pipe; and a tube provided within said well vat and connected at a first end to said inlet, a second end thereof opening in a normal position into said well vat adjacent to said outlet for passing liquid continuously into said outlet, said tube being arranged as a floating tube and being pivotally mounted at said first end to be pivoted in a vertical direction from said normal position when liquid is accumulated in said well vat while said second end is moved to and detained in a position above the surface of the accumulated liquid;

said inlet and outlet being arranged in front of each other in opposite side walls or parts of side walls of said well vats, said floating tube in normal position being arranged essentially in alignment with said inlet and said outlet;

said floating tube comprises a tube and a floating body provided externally on said tube.

17. Back flow blocker according to claim 16, wherein said second end of said floating tube, having a bottom, is obliquely cut off at an acute angle to said bottom of said tube, and wherein said floating tube in a pivoted upper end position is engaged with a closing means provided stationary in said well vat.

18. Back flow blocker according to claim 16, wherein said well vat is provided at a reservoir having a riser arranged as an inspection piece.

19. Back flow blocker in sloping pipes, comprising a well vat having an inlet and an outlet which are connected to the pipe; and a tube provided within said well vat and connected at a first end to said inlet, a second end thereof opening in a normal position into said well vat adjacent to said outlet for passing liquid continuously into said outlet, said tubes being arranged as a floating tube and being pivotally mounted at said first end to be pivoted in a vertical direction from said normal position when liquid is accumulated in said well vat while said second end is moved to and detained in a position above the surface of the accumulated liquid;

said second end of said floating tube, having a bottom, being obliquely cut off at an acute angel to said bottom os said tube, and said floating tube in a pivoted upper end position being engaged with a closing means provided stationary in said well vat.

20. Back flow blocker according to claim 19, wherein said floating tube comprises a tube and a floating body provided externally on said tube.

21. Back flow blocker according to claim 19, wherein said well vat is provided at a reservoir having a riser arranged as an inspection piece.

* * * * *